US008973775B2

(12) United States Patent
Shonborn

(10) Patent No.: US 8,973,775 B2
(45) Date of Patent: Mar. 10, 2015

(54) DISPOSABLE BEVERAGE CONTAINER ADAPTED TO DISPENSE AN ITEM THROUGH THE SIDE OF THE CONTAINER

(71) Applicant: Corey Shonborn, Noblesville, IN (US)

(72) Inventor: Corey Shonborn, Noblesville, IN (US)

( * ) Notice: Subject to any disclaimer, the term of this patent is extended or adjusted under 35 U.S.C. 154(b) by 0 days.

(21) Appl. No.: 14/298,905

(22) Filed: Jun. 7, 2014

(65) Prior Publication Data

US 2014/0361017 A1 Dec. 11, 2014

Related U.S. Application Data

(60) Provisional application No. 61/832,230, filed on Jun. 7, 2013.

(51) Int. Cl.
*A47G 19/22* (2006.01)
*B65D 75/32* (2006.01)
*B65D 83/04* (2006.01)

(52) U.S. Cl.
CPC ..... *A47G 19/2205* (2013.01); *B65D 83/04* (2013.01); *B65D 75/325* (2013.01); *B65D 75/32* (2013.01)
USPC ..... 220/503; 206/223; 206/217

(58) Field of Classification Search
CPC .... B65D 85/30; B65D 75/327; B65D 75/325; B65D 75/32; B65D 83/0445; B65D 83/04; A45C 11/00
USPC ..... 220/266, 265, 260, 281, 505, 527, 524, 220/504, 503, 625, 703, 212; 206/223, 541, 206/800, 532, 531, 539, 538, 535, 217, 206/216; 426/106; 229/404, 401
See application file for complete search history.

(56) References Cited

U.S. PATENT DOCUMENTS

| | | | | |
|---|---|---|---|---|
| 2,766,796 | A * | 10/1956 | Tupper | 220/521 |
| 3,326,363 | A * | 6/1967 | Bennett et al. | 206/219 |
| 3,526,316 | A * | 9/1970 | Kalogris | 206/217 |
| 3,920,120 | A * | 11/1975 | Shveda | 206/217 |
| 6,708,735 | B1 * | 3/2004 | Kenihan | 141/18 |
| 7,121,991 | B2 | 10/2006 | Mannlein et al. | |
| 7,845,489 | B2 * | 12/2010 | Thompson | 206/217 |

* cited by examiner

*Primary Examiner* — Robert J Hicks
(74) *Attorney, Agent, or Firm* — Roberts IP Law; John Roberts

(57) ABSTRACT

Provided is a disposable beverage container adapted to dispense an item through the side of the container. The open space in the downward-facing cavity at the bottom of many typical cups is utilized by providing therein one or more deflectable storage members, such as a blister-pack-type storage member, with an item sealed inside such as gum, a mint; candy; a pharmaceutical; a prize; a toy; or any other item. The item can be dispensed by pushing radially outward on the deflectable storage member and causing the item to break through a breakable member on the outside of the cup, such as aluminum foil. Various example embodiments, materials, and methods are described.

20 Claims, 3 Drawing Sheets

DISPOSABLE BEVERAGE CONTAINER ADAPTED TO DISPENSE AN ITEM THROUGH THE SIDE OF THE CONTAINER

CROSS-REFERENCE TO RELATED APPLICATIONS

This application claims priority to, incorporates herein by reference, and is a non-provisional of U.S. Provisional Patent Application Ser. No. 61832230 to Corey Shonborn, entitled Apparatus, System, and Method Dispensibly Combining One Or More Pieces Of Gum, Mints, Or The Like With A Disposable Coffee Cup Or Other Similar Beverage Container, filed on Jun. 7, 2013.

FEDERALLY SPONSORED RESEARCH OR DEVELOPMENT

None.

TECHNICAL FIELD

The present invention relates generally to packaging for consumer products, and more specifically to apparatus, systems, and methods that dispensably combine one or more pieces of gum, mints, or the like with a disposable coffee cup or other similar beverage container.

BACKGROUND

One night, applicant and his friend went to go try a new drink at a coffee shop, the applicant saw a packet of gum by the cash register. Applicant thought, it's so perfect to have that there. What's the first thing you think of when you think of coffee? Coffee breath. How to cure it? With a piece of gum or a mint or the like. Then applicant thought, wouldn't it be neat if there was some convenient and commercially practical way to package these types of things with a cup for coffee (or tea, or other drinks)?

SUMMARY

That's when the thought struck applicant; he could design a coffee cup where the mint or gum piece is attached to the cup, conveniently already there for you, when you are done drinking your beverage. Thus the present invention was born, and has developed into several different example embodiments of an apparatus, system, and method dispensably combining one or more pieces of gum, mints, or the like with a disposable coffee cup or other similar beverage container.

By way of example and not limitation, presently provided in one example embodiment is an apparatus adapted to dispensably combine an item with a disposable beverage container, comprising: a disposable beverage container comprising an outer portion extending from an upper portion downward past a bottom of a fluid containing portion to a lower portion, and a downward-facing open cavity having a sidewall extending downward from the bottom of the fluid containing portion; one or more deflectable storage members affixed to the disposable beverage container and residing within the downward-facing open cavity proximate to the sidewall; one or more breakable members located proximate the outer portion of the disposable beverage container and proximate to the sidewall and the one or more deflectable storage members; one or more items sealed within the one or more deflectable storage members; wherein the apparatus is adapted to dispense the one or more items from the one or more deflectable storage members through the one or more breakable members when the one or more deflectable storage members are deflected toward the outer portion of the disposable beverage container.

In various example embodiments the disposable beverage container may be a coffee cup and the one or more items may comprise a piece of gum. In various example embodiments the one or more deflectable storage members may comprise substantially transparent plastic. In various example embodiments the one or more deflectable storage members may comprise plastic and the bottom of the fluid containing portion of the disposable beverage container may form a backing for the one or more deflectable storage members. In various example embodiments the one or more breakable members may comprise aluminum foil. In various example embodiments the one or more items comprise: a mint; candy; a pharmaceutical; a prize; a toy; or any item capable of being dispensed from a container as disclosed herein.

The foregoing summary is illustrative only and is not meant to be exhaustive. Additional aspects, alternatives and variations as would be apparent to persons of skill in the art are also disclosed herein and are specifically contemplated as included as part of the invention. The invention is set forth only in the claims as allowed by the patent office in this or related applications, and the following summary descriptions of certain examples are not in any way to limit, define or otherwise establish the scope of legal protection.

BRIEF DESCRIPTION OF THE DRAWINGS

The accompanying figures illustrate certain aspects of example embodiments of the invention.

DETAILED DESCRIPTION OF EXAMPLE EMBODIMENTS

Figure 1:
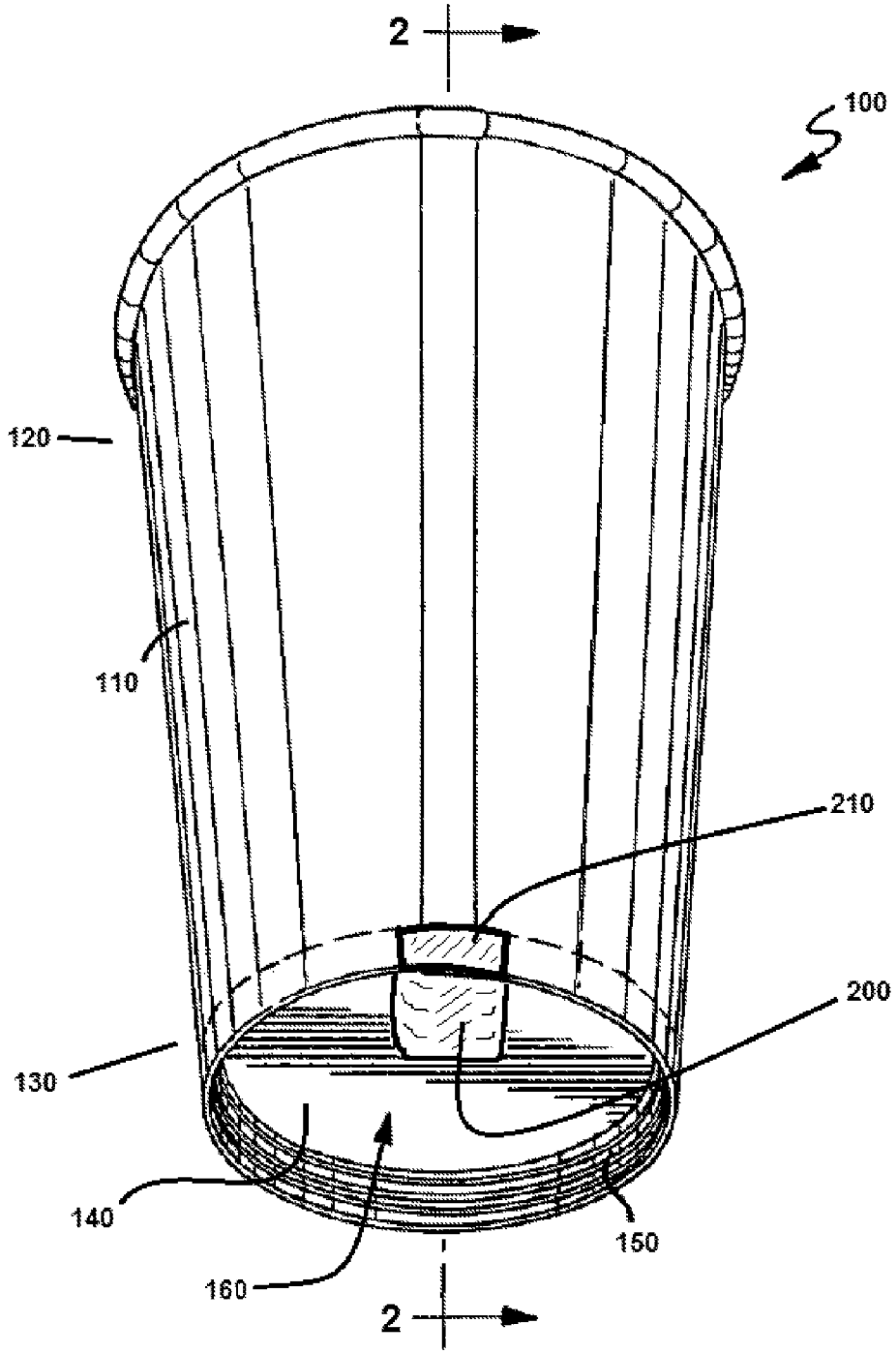
FIG. 1 is bottom perspective view of disposable cup adapted to dispense one or more pieces of gum, mints, or other items according to various example embodiments of the invention.

Reference is made herein to some specific examples of the present invention, including any best modes contemplated by the inventor for carrying out the invention. Examples of these specific embodiments are illustrated in the accompanying figures. While the invention is described in conjunction with these specific embodiments, it will be understood that it is not intended to limit the invention to the described or illustrated embodiments. To the contrary, it is intended to cover alternatives, modifications, and equivalents as may be included within the spirit and scope of the invention as defined by the claims that will be appended in any subsequent regular utility patent application claiming priority to this provisional application.

In the following description, numerous specific details are set forth in order to provide a thorough understanding of the present invention. Particular example embodiments of the present invention may be implemented without some or all of these features or specific details. In other instances, components and process operations well known to persons of skill in the art have not been described in detail in order not to obscure unnecessarily the present invention.

Various techniques and mechanisms of the present invention will sometimes be described in singular form for clarity. However, it should be noted that some embodiments may include multiple iterations of a technique or multiple components, mechanisms, and the like, unless noted otherwise. Similarly, various steps of the methods shown and described herein are not necessarily performed in the order indicated, or performed at all in certain embodiments. Accordingly, some implementations of the methods discussed herein may include more or fewer steps than those shown or described.

Further, the techniques and mechanisms of the present invention will sometimes describe a connection, relationship or communication between two or more items or entities. It should be noted that a connection or relationship between entities does not necessarily mean a direct, unimpeded connection, as a variety of other entities or processes may reside or occur between any two entities. Consequently, an indicated connection does not necessarily mean a direct, unimpeded connection unless otherwise noted.

When trying to figure out how the applicant's goals could be accomplished, the applicant first thought to put the gum, mint, or other item on a lid on top of the cup. However, testing indicated that in the case of cups holding hot drinks like coffee or tea, the gum, mint, or similar item would tend to melt or degrade, since heat rises. Additionally, placing the item in or about a lid would make the lid much thicker, reducing the ability to easily and compactly stack and dispense the lids. Lids for disposable cups are typically stacked compactly for efficient shipping and dispensing, with each lid vertically nested in an identical lid below it so that each lid typically takes up no more vertical space than the approximate thickness of the lid material.

Eventually the applicant counter-intuitively decided to try to place the gum, mint, or any other item that consumers would like on or about the bottom of a typical disposable cup, for instance in the downward-facing cavity that is typically formed by the sidewalls of a cup extending downward from the bottom edge of the fluid containing portion of the cup. Examples of this type of cup and its associated methods of manufacture are shown in U.S. Pat. No. 7,121,991 B2 to Mannlein, et al., issued Oct. 17, 2006 ("Mannlein"), the entirety of which is incorporated herein by reference. Since heat rises, and since the materials forming the bottom of the cup would tend to act as an insulator, the problems with heat associated with placing the gum, mint, or similar item in a lid would be ameliorated. Also, utilizing the space in the downward-facing cavity on the bottom portions of typical disposable cups would have little to no impact on stacking or dispensing the cups, because the downward-facing cavity at the bottom of typical disposable cups typically remains unoccupied when identical cups are stacked one on top of another in the usual way, namely vertically in a nesting fashion.

Figure 2:
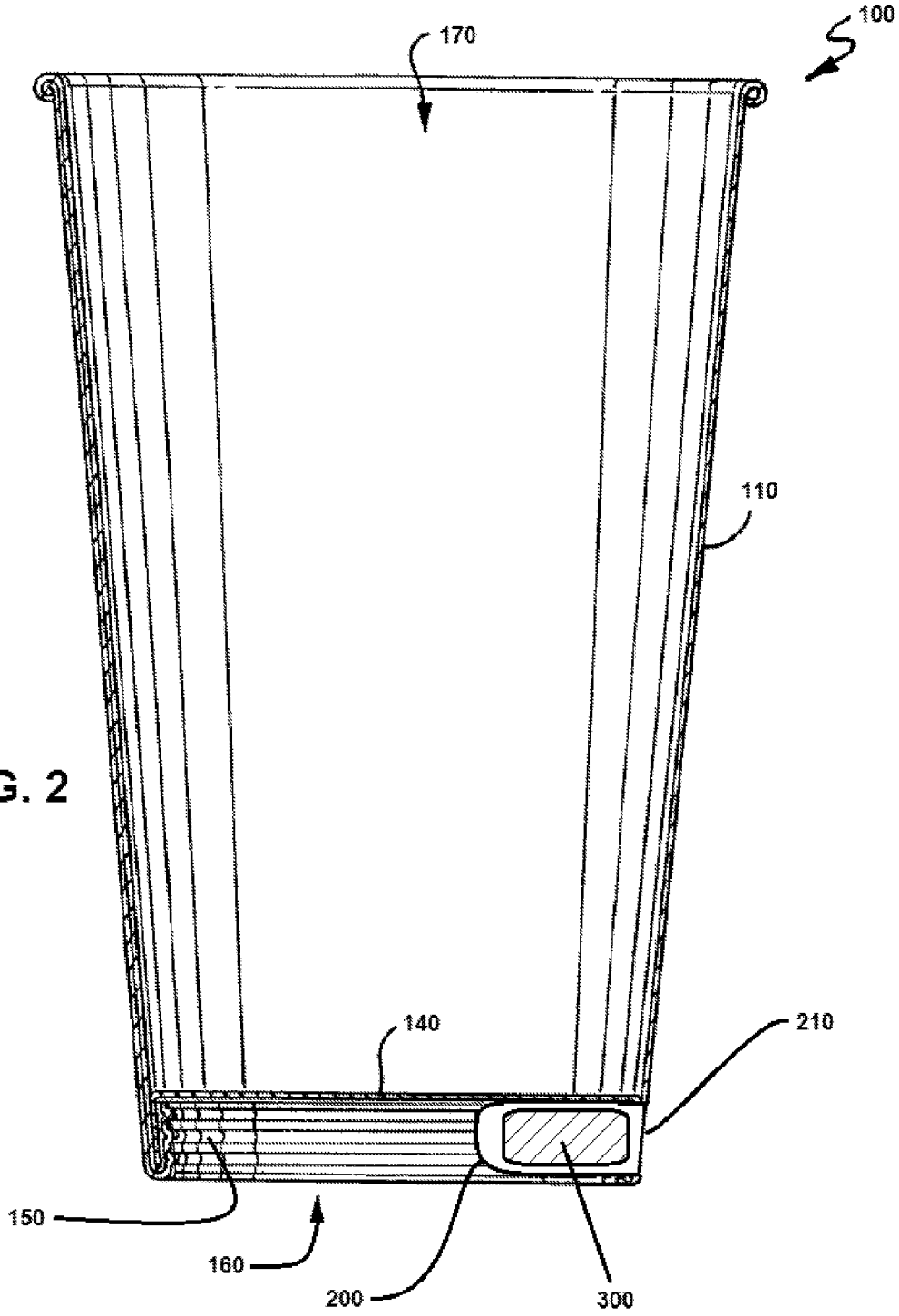
FIG. 2 is a cross-sectional view about line 2-2 of the example cup of FIG. 1.

Accordingly, applicant has invented various structures and methods for dispensably combining one or more pieces of gum, mints, or other items within the downward-facing cavity at the bottom of typical disposable cups or other similar beverage containers. For example, with reference to FIGS. 1 and 2, provided is disposable cup or similar beverage container 100 having an outer portion 110 extending vertically downward from an upper portion 120 to a lower portion 130. The outer portion 110 may extend downward past the bottom 140 of the fluid containing portion 170 of the cup 100, thereby forming sidewalls 150 extending downward from the bottom 140 of the fluid containing portion 170 of the cup 100, where the sidewalls 150 and bottom 140 together form a downward-facing cavity 160, which is open to the bottom as shown in FIG. 1. Downward-facing cavity 160 is typically an unoccupied volume of space in many typical disposable cups, such as paper-based coffee cups, tea cups, and the like, even when the cups are stacked for storage, transportation, or dispensing for use by consumers.

In various example embodiments, applicant has introduced into the downward-facing cavity 160 one or more deflectable storage members 200 (herein "storage members 200"), each adapted to physically contain one or more items 300. Item 300 may comprise one or more pieces of gum, mints, candies, pharmaceuticals, prizes, toys, or any other suitable item.

Storage member 200 may be adapted to provide sufficient physical protection for the item 300, for instance, from shock, vibration, compression, temperature, and the like, and may be adapted to provide appropriate barrier protection for the item 300, for instance, a barrier from oxygen, water vapor, dust, germs, humidity, contamination, and the like, to keep the item 300 clean, fresh, and safe for its intended shelf life. Storage member 200 may for example comprise one or more blister pack type storage designs, for instance pre-formed plastic packaging as used for small consumer goods, foods, and for pharmaceuticals. For example, storage member 200 may comprise a cavity or pocket made from a formable web, such as a thermoformed plastic, which may use the bottom 140 of the cup 100 as a backing, such as a paper backing.

Storage member 200 may be located adjacent the side 110 of the cup 100, for instance against the sidewall 150 of the downward-facing cavity 160. As shown in FIGS. 1 through 3C, the portion of the sidewall 150 adjacent the storage member 200 may comprise a breakable member 210 to allow the item 300 to be removed from the storage member 200 by breaking the breakable member 210 and passing the item 300 through the sidewall 150.

Examples of materials that may be used to form storage member 200 are discussed below. This information was obtained in part from the Wikipedia website under the topic Blister pack. In the case of thermoforming the storage member 200, a plastic film or sheet (not shown) may be unwound from a reel and guided though a pre-heating station on a blister line. The temperature of the pre-heating plates (upper and lower plates) is such that the plastic that will form the body of the storage member 200 will soften and become pliable. The warm plastic will then arrive in a forming station where a large pressure (4 to 8 bar) will form the blister cavity into a negative mold. The mold is cooled such that the plastic becomes rigid again and maintains its shape when removed from the mold. In case of difficult shapes, the warm film will be physically pushed down partially into the cavity by a "plug-assist" feature. Plug-assist results in a blister cavity with more uniform wall distribution and is typically used when the cavity size and shape is adapted for an item 300 larger than a small tablet.

In the case of cold forming the storage member 200, an aluminum-based laminate film may simply be pressed into a mold by means of a stamp. The aluminum will be elongated and maintain the formed shape. In the pharmaceutical industry these blisters are called cold form foil (CFF) blisters. The principal advantage of cold form foil blisters is that the use of aluminum offers a near complete barrier for water and oxygen, allowing an extended product expiry date. The principal disadvantages of cold form foil blisters are: the slower speed of production compared to thermoforming; the lack of transparency of the package (a therapy compliance disadvantage); and the larger size of the blister card.

Figure 3A:
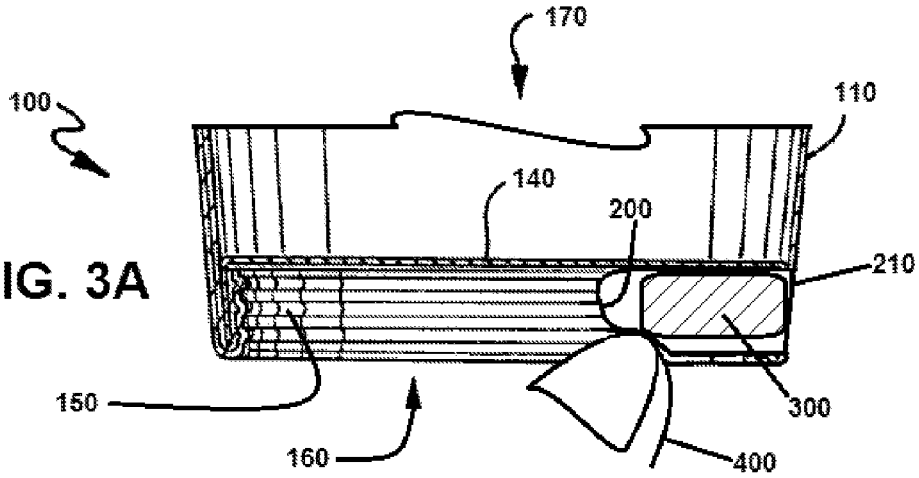
FIG. 3A is a partial view of the cross-sectional view of FIG. 2, showing a piece of gum or other item combined with the cup, according to various example embodiments of the invention.
Figure 3B:
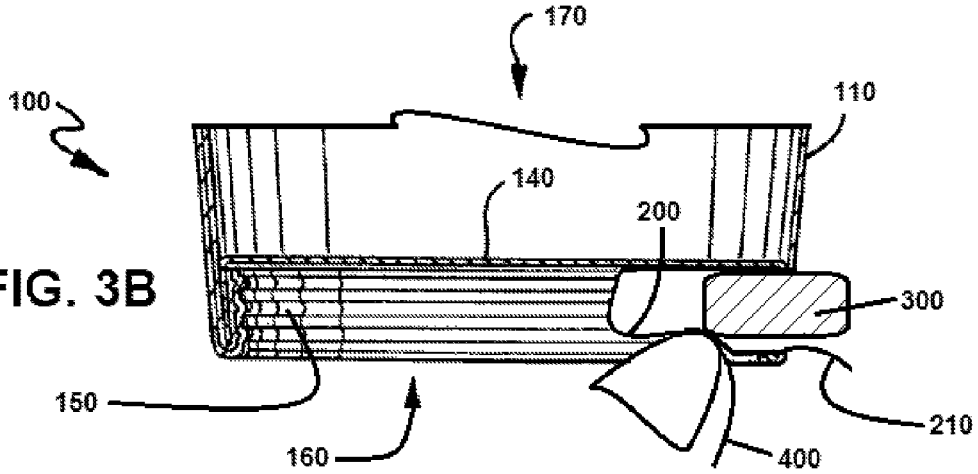
FIG. 3B is a partial view of the cross-sectional view of FIG. 2, showing a piece of gum or other item partially dispensed from the cup, according to various example embodiments of the invention.
Figure 3C:
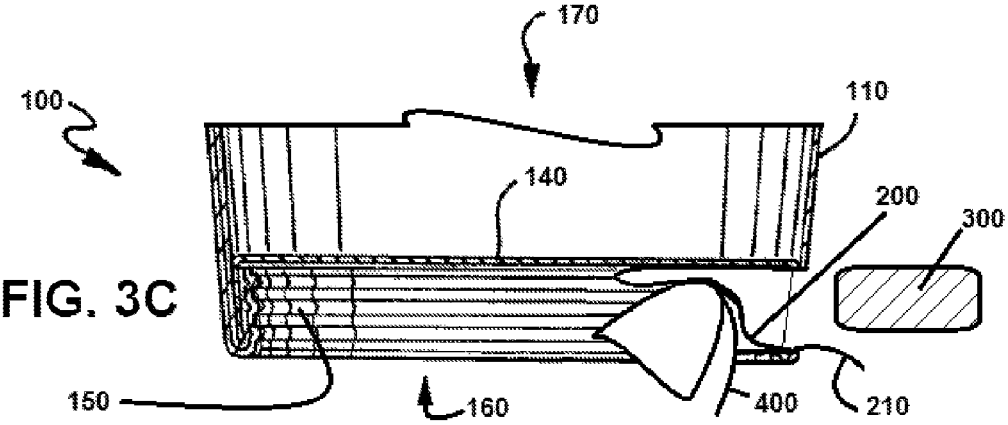
FIG. 3C is a partial view of the cross-sectional view of FIG. 2, showing a piece of gum or other item fully dispensed from the cup, according to various example embodiments of the invention.

A basic material for forming the storage member 200 is polyvinyl chloride (PVC). The principal advantages of PVC are the low cost and the ease of thermoforming. The main disadvantages are poor barriers against moisture ingress and oxygen ingress. In the case of blister packaging the PVC sheet does not contain any plasticizer and is sometimes referred to as Rigid PVC or RPVC. In the absence of plasticizers, PVC blisters offer structural rigidity and physical protection for the item 300. On the other hand, the storage member 200 should remain accessible to be used with the push-through effect as shown in FIGS. 3A through 3C, and the formed storage member 200 should not be too hard to collapse when pressed upon, for instance by a user's finger 400. For this reason the PVC sheet thickness may be chosen between 200μ to 300μ depending on the size and shape of the storage member 200. Most PVC sheets for pharmaceutical blisters are 250μ or 0.250 mm in thickness. Typical values for the Water Vapor Transmission Rate (WVTR or MVTR) of a 250μ PVC film are around 3.0 g/m2/day measured at 38° C./90% RH and the Oxygen Transmission Rate (OTR) is around 20 mL/m2/day. In order to overcome the lack of barrier properties of PVC film, it can be coated with PVDC or laminated to PCTFE or COC to increase the protective properties. Multi-layer blister films based on PVC are often used for pharmaceutical blister packaging, whereby the PVC serves as the thermoformable backbone of the structure. Also, the PVC layer can be colored with pigments and/or UV filters. The European Pharmacopoeia (Ph Eur) references the requirements for PVC blister packs for pharmaceutical primary packaging in the monograph EP 3.1.11 "Materials Based On Non-Plasticised Poly (Vinyl Chloride) For Containers For Dry Dosage Forms For Oral Administration". In order to be suitable for pharmaceutical blister packs, the PVC formulation also needs to comply with the US Pharmacopoeia <661>; EU food legislation; US 21.CFR and Japanese food contact requirements. These requirements may or may not apply to item 300, depending on the nature of the item.

Polychlorotrifluoro-ethylene or PCTFE can be laminated to PVC to obtain very high moisture barrier. Typical constructions used for pharmaceutical products are 250μ PVC film laminated to 15μ-150μ PCTFE film. Duplex structures are PVC/PCTFE and triplex laminates are PVC/PE/PCTFE. Deeper cavities can be formed by using the triplex structures with PE. Typical WVTR values are 0.06-0.40 g/m2/day.

Cyclic olefin copolymers (COC) or polymers (COP) can provide moisture barrier to storage member 200, typically in multilayered combinations with polypropylene (PP), polyethylene (PE), or glycol-modified polyethylene terephthalate (PETg). Cyclic olefin resins are generally amorphous and are noted for good thermoforming characteristics even in deep cavities, leading some to use COC in blister packaging as a thermoforming enhancer, particularly in combination with semicrystalline resins such as PP or PE. Films can be manufactured via coextrusion or lamination. WVTR values of commercial cyclic olefin-based pharmaceutical blister films typically range from 0.20 to 0.35 g/m2/day at 38° C./90% RH. Unlike PVC and other common pharmaceutical barrier resins, cyclic olefin resins do not contain chlorine or other halogens in their molecular structure, being composed solely of carbon and hydrogen. Cyclic olefin resins are available which comply with pharmaceutical packaging guidelines in the US, Europe, and Japan.

Storage member 200 may be attached to the bottom 140, or the sidewall 150, or both, by any suitable means, such as via heat sealing, ultrasonic welding, gluing, taping, or any suitable attachment material, process, or mechanism. The atmosphere in the interior of storage member 200 may be substantially a vacuum, or may be a special atmosphere such as primarily nitrogen, or may be normal atmospheric air.

Breakable member 210 may comprise any suitable material, such as paper (including cardboard), plastic, or aluminum foil, such as commercially available aluminum blister foil packaging. While breakable member 210 is shown in FIG. 1 as extending just a short distance around the perimeter of the cup 100, in other embodiments the material comprising the breakable member may extend further around the perimeter of the bottom portion 130 of the cup 100, for instance all the way around the bottom portion 130, near or below the bottom 140 (for instance for appearance or ease of manufacturing or to facilitate having a plurality of storage members 200 functioning as shown in FIGS. 3A-3C).

In use, as shown in FIGS. 3A-3C, a user may apply force to the storage member 200, for instance via the user's finger 400, pushing radially outward toward the outside 110 of the cup 100. By applying such force to the storage member 200, the storage member at least partially deflects or collapses against the item 300, forcing the item 300 to move radially outward and against the breakable member 210 as shown in FIG. 3A. When sufficient force having a radially outward component is applied to the deflectable storage member 200 and thus to the item 300, the item 300 breaks through the breakable member 210 as shown in FIG. 3B, and the item 300 then emerges or is removed from the storage member 200 by passing through the sidewall 150 of the side 110 of the cup 100 as shown in FIG. 3C. The user 300 can then consume or otherwise make use of the item 300. Note that the item 300 as shown in the Figures is just a generic example, and is not necessarily to scale for any given example.

Any of the suitable technologies set forth and incorporated herein may be used to implement various example aspects of the invention as would be apparent to one of skill in the art.

Although exemplary embodiments and applications of the invention have been described herein including as described above and shown in the included example Figures, there is no intention that the invention be limited to these exemplary embodiments and applications or to the manner in which the exemplary embodiments and applications operate or are described herein. Indeed, many variations and modifications to the exemplary embodiments are possible as would be apparent to a person of ordinary skill in the art. The invention may include any device, structure, method, or functionality, as long as the resulting device, system or method falls within the scope of one of the claims that are allowed by the patent office based on this or any related patent application.

What is claimed is:

1. An apparatus adapted to dispensably combine an item with a disposable beverage container, comprising:

a disposable beverage container comprising an outer portion extending from an upper portion downward past a bottom of a fluid containing portion to a lower portion, and a downward-facing open cavity having a sidewall extending downward from the bottom of the fluid containing portion;

one or more deflectable storage members affixed to the disposable beverage container and residing within the downward-facing open cavity proximate to the sidewall;

one or more breakable members located proximate the outer portion of the disposable beverage container and proximate to the sidewall and the one or more deflectable storage members;

one or more items sealed within the one or more deflectable storage members;

wherein the apparatus is adapted to dispense the one or more items from the one or more deflectable storage members through the one or more breakable members when the one or more deflectable storage members are deflected toward the outer portion of the disposable beverage container.

2. The apparatus of claim 1, wherein the disposable beverage container is a coffee cup and the one or more items comprise a piece of gum.

3. The apparatus of claim 1, wherein the one or more deflectable storage members comprise substantially transparent plastic.

4. The apparatus of claim 1, wherein the one or more deflectable storage members comprise plastic and the bottom of the fluid containing portion of the disposable beverage container forms a backing for the one or more deflectable storage members.

5. The apparatus of claim 1, wherein the one or more breakable members comprise aluminum foil.

6. The apparatus of claim 1, wherein the one or more items comprise: a mint.

7. The apparatus of claim 1, wherein the one or more items comprise: candy.

8. The apparatus of claim 1, wherein the one or more items comprise: a pharmaceutical.

9. The apparatus of claim 1, wherein the one or more items comprise: a prize.

10. The apparatus of claim 1, wherein the one or more items comprise: a toy.

11. A disposable beverage container comprising:

an outer portion extending from an upper portion downward past a bottom of a fluid containing portion to a lower portion, and a downward-facing open cavity having a sidewall extending downward from the bottom of the fluid containing portion;

one or more deflectable storage members affixed to the disposable beverage container and residing within the downward-facing open cavity proximate to the sidewall;

one or more breakable members located proximate the outer portion of the disposable beverage container and proximate to the sidewall and the one or more deflectable storage members;

one or more items sealed within the one or more deflectable storage members;

wherein the disposable beverage container is adapted to dispense the one or more items from the one or more deflectable storage members through the one or more breakable members when the one or more deflectable storage members are deflected toward the outer portion of the disposable beverage container.

12. The disposable beverage container of claim 11, wherein the disposable beverage container is a coffee cup and the one or more items comprise a piece of gum.

13. The disposable beverage container of claim 11, wherein the one or more deflectable storage members comprise substantially transparent plastic.

14. The disposable beverage container of claim 11, wherein the one or more deflectable storage members comprise plastic and the bottom of the fluid containing portion of the disposable beverage container forms a backing for the one or more deflectable storage members.

15. The disposable beverage container of claim 11, wherein the one or more breakable members comprise aluminum foil.

16. The disposable beverage container of claim 11, wherein the one or more items comprise:

a mint.

17. The disposable beverage container of claim 11, wherein the one or more items comprise:

candy.

18. The disposable beverage container of claim 11, wherein the one or more items comprise:

a pharmaceutical.

19. The disposable beverage container of claim 11, wherein the one or more items comprise:

a prize.

20. The disposable beverage container of claim 11, wherein the one or more items comprise:

a toy.

* * * * *